US006505925B2

(12) United States Patent
Kitabatake et al.

(10) Patent No.: US 6,505,925 B2
(45) **Date of Patent: *Jan. 14, 2003**

(54) METHOD FOR INSERTING ABSORBENT INTO CONTAINER AND CONTAINER RECEIVING ABSORBENT PRODUCED BY THE METHOD

(75) Inventors: Kenji Kitabatake, Kawasaki (JP); Osamu Morita, Yokosuka (JP); Hiroshi Koshikawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/888,963

(22) Filed: Jun. 27, 2001

(65) Prior Publication Data

US 2001/0035898 A1 Nov. 1, 2001

Related U.S. Application Data

(62) Division of application No. 09/425,004, filed on Oct. 25, 1999, now Pat. No. 6,286,947.

(30) Foreign Application Priority Data

| | | |
|---|---|---|
| Oct. 27, 1998 | (JP) | 10-306180 |
| Dec. 14, 1998 | (JP) | 10-354620 |
| Oct. 20, 1999 | (JP) | 11-298599 |

(51) Int. Cl.[7] ..... B41J 2/175
(52) U.S. Cl. ..... 347/86
(58) Field of Search ..... 347/85, 86, 87; 29/451, 530

(56) References Cited

U.S. PATENT DOCUMENTS

| | | | | |
|---|---|---|---|---|
| 5,319,841 A | | 6/1994 | Yata et al. | 29/451 |
| 5,400,067 A | | 3/1995 | Day | 347/87 |
| 6,059,916 A | | 5/2000 | Betschon | 156/256 |
| 6,231,171 B1 | * | 5/2001 | Yamashita et al. | 347/86 |
| 6,286,947 B1 | * | 9/2001 | Kitabatake et al. | 347/86 |
| 6,293,663 B1 | * | 9/2001 | Koshikawa et al. | 347/86 |

FOREIGN PATENT DOCUMENTS

| | | | |
|---|---|---|---|
| EP | 0 466 142 | | 1/1992 |
| EP | 0 520 695 | | 12/1992 |
| EP | 0 842 780 | | 5/1998 |
| JP | 9-131877 | * | 5/1997 |

OTHER PUBLICATIONS

09/425,004,Kitabatake et al.,Method for Inserting an Absorbent into a Container, Oct. 25, 1999, pp 1–31.*

* cited by examiner

*Primary Examiner*—Michael Nghiem
(74) *Attorney, Agent, or Firm*—Fitzpatrick, Cella, Harper & Scinto

(57) ABSTRACT

A method for inserting an absorbent to a container of which receiving space is smaller then the absorbent, and a container receiving an absorbent inserted by the method. The method includes the steps of compressing the absorbent with a first and a second pressing members, inserting the absorbent to the container, together with the first and the second pressing members, and removing the first and the second pressing members from the container while the absorbent is held in the container, wherein the electric charge on the first and the second pressing members contacting with the absorbent is removed.

8 Claims, 4 Drawing Sheets

METHOD FOR INSERTING ABSORBENT INTO CONTAINER AND CONTAINER RECEIVING ABSORBENT PRODUCED BY THE METHOD

This application is a division of Application No. 09/425,004, filed Oct. 25,1999, now U.S. Pat. No. 6,286,947.

BACKGROUND OF THE INVENTION

1. Field of the Invention

The present invention broadly relates to methods for manufacturing printing devices. Particularly, the present invention relates to a method for inserting to an ink container an absorbent to be impregnated with liquid ink, larger than the receiving space of the ink container, and relates to a container receiving the absorbent inserted by the method.

2. Description of the Related Art

Hitherto, a printing device for a miniaturized ink-jet printing apparatus has been proposed, in which an integral type device including a printing head and an ink container is detachably installed. Such integral cartridge-type device must apply a predetermined level of reduced pressure in the printing head with respect to the pressure in the ink container. A method for obtaining a proper ink flow from the ink container to the printing head under such a reduced pressure is known, in which the ink container receives an absorbent impregnated with ink.

In the process of manufacturing the above-described ink container, the absorbent in a compressed state is manually inserted to the ink container and impregnated with ink. Such manual operation is time consuming and inadequate for the production in volume. Also, a problem is found that the absorbent gets improperly wrinkled when inserted, and/or unevenly contacts to the inner wall of the ink container.

The ink stays gathered in the wrinkles of the absorbent and/or in the gaps between the absorbent and the inner wall of the ink container, which are formed by the above-described manual operation. The ink stagnant in the wrinkles and/or the gaps remains unused, preventing smooth ink supply flow and proper ink jetting for printing, thus deteriorating printing quality.

A method is known in which, in order to overcome the above-described problem, the absorbent is evenly compressed by a jig before insertion to the ink container. The absorbent inserted to the ink container in an evenly compressed state provides no room for ink to stay gathered. Even that, however, the ink added to the absorbent can not be efficiently used out.

In order to efficiently utilize the ink in the ink container, the density of the absorbent is preferably increased gradually toward the ink outlet for the printing head.

A method for producing a density distribution in an absorbent received in a container is proposed, in which the absorbent is inserted to the container through an opening, in a manner that two pairs of the opposed sides of the absorbent are evenly pressed by a pair of first pressing members and a pair of second pressing members respectively, and the container is moved to receive the absorbent while one of the remainder sides of the absorbent free from the first and second pairs of pressing members is pushed by a third pressing member. The first and the second pressing members are removed in accordance with the timing of the third pressing member moving in. Another method is known, for controlling density distribution of the absorbent by controlling moving speed of the container and friction coefficient between the absorbent and the pressing members.

In the above methods, however, the density distribution state in the absorbent is hardly stabilized because the friction coefficient between the pressing members and the absorbent varies according to the amount of the triboelectric charges produced by the friction between the absorbent and the pressing members and between the pressing members and the container and stored on the pressing members, in the course of repeated operation of the absorbent insertion.

The conventional methods, moreover, do not sufficiently enable a desired density distribution in the absorbent to be obtained, because the density distribution is intended to be produced by controlling only timing of in-out movements of the pressing members.

SUMMARY OF THE INVENTION

Accordingly, it is an object of the present invention to provide a method for inserting an absorbent, and a container receiving an absorbent inserted thereby, in which, by removing the electric charges stored on pressing members, friction coefficient fluctuation caused in the course of repeated insertion is suppressed to stabilize received state of the absorbent in the container, the removal of charges also serving to suppress the risk of receiving dust in the container, by reducing the dust amount to be adsorbed on the pressing members in the absorbent insertion process.

It is another object of the present invention to provide a method for inserting an absorbent to a container, as well as a container receiving the absorbent, wherein the absorbent is arranged before insertion to the container so that the absorbent has a desired density distribution.

It is a further object of the present invention to provide a method for inserting an absorbent to a container, enabling a desired density distribution in the absorbent to be maintained after repeated insertion process of the absorbent arranged to have the desired density distribution.

In an aspect of the present invention, a method for inserting an absorbent to a container of which receiving space is smaller than the absorbent, comprises the steps of compressing the absorbent with a pressing member, inserting the absorbent together with the pressing member to the container, and removing the pressing member from the container while the absorbent is held in the container, wherein the pressing member contacting with the absorbent is diselectrified.

The absorbent to be inserted to the container by the method, may be made of a material selected from the group consisting of polyurethane, polypropylene, and polyethylene.

The container receiving the absorbent by the method, may be made of one of polypropylene, a polystyrene-based resin, and polyethylene terephthalate.

The pressing members for compressing the absorbent in the method, may be either coated with polytetrafluoroethylene (hereinafter referred to as PTFE), or covered with PTFE sheet thereon.

The pressing members for compressing the absorbent in the method, may be covered with polyethylene film thereon.

Further, the pressing members for compressing the absorbent in the method, may be coated with a fluorocarbon resin.

The pressing members for compressing the absorbent in the method may be made of a PTFE resin.

According to another aspect of the present invention, a container receiving an absorbent is produced by a method for inserting an absorbent to the container of which receiving space is smaller than the absorbent, the method comprising the steps of compressing the absorbent with a pressing member, inserting the absorbent together with the pressing member, and removing the pressing member from the container while the absorbent is held in the container, wherein the pressing member contacting with the absorber is capable of being diselectrified. The container may be made of one of polypropylene, a polystyrene-based resin, and polyethylene terephthalate, and the absorbent may be made of one of polyurethane, polypropylene, and polyethylene.

According to still another aspect of the present invention, a method for inserting an absorbent to a container comprises: a first step of compressing the absorbent with a pair of pressing members opposed to each other, a portion of the absorbent unevenly protruding from the pressing members; a second step of compressing the absorbent with a pair of pressing members opposed to each other, in a direction crossing the direction of the compression in the first step; a step of inserting the absorbent to the container together with the pressing members maintaining the absorbent in a compressed state; and a step of removing the pressing members from the container while the absorbent is held in the container.

By this method, the density of the absorbent is distributed therein varying depending on the portion thereof, which is produced by preventing compressive force from being evenly transmitted in the absorbent, by the effect of the frictional force acting between the absorbent and the pressing members, generated by compressing the absorbent under compression by a pair of pressing members, with another pair of other pressing members in the compression direction crossing the compression direction by the former pressing members. The absorbent is prevented from wrinkling, by inserting the pressing members together with the absorbent, clamping the absorbent in a compressed state.

In the method, the protruding length of the absorbent, from the edges of the pressing members, may be 0.01 to 0.5 times as large as the length, in the protruding direction, of the absorbent, which enables the density distribution in the absorbent to be varied as desired.

In the method, the density distribution in the absorbent may be produced along the direction of compression in the second step, by compressing, with the pressing members in the second step, the protruding portion of the absorbent compressed by the pressing members in the first step.

Further, in the method, the container may be provided with a liquid outlet adjacent to a position in the container, where a relatively large volume of the absorbent protrusion from the edges of the pressing members used in the first step is received.

According to a further aspect of the present invention, a container receiving an absorbent is provided, made by a method comprising: a first step of compressing the absorbent with a pair of pressing members opposed to each other, a portion of the absorbent unevenly protruding from the pressing members; a second step of compressing the absorbent with another pair of pressing members opposed to each other, in a direction crossing the direction of the compression in the first step; a step of inserting the absorbent to the container together with the pressing members maintaining the absorbent in a compressed state; and a step of removing the pressing members from the container while the absorbent is held in the container.

The container made by the method may utilize the liquid added to the absorbent more efficiently than a liquid container having an evenly compressed absorbent, because the absorbent is compressed so that the density thereof is distributed therein varying depending on the portion of the absorbent.

In the method for manufacturing the container whereby the container is provided as described above, the protruding length of the absorbent, from the edges of the pressing members, may be 0.01 to 0.5 times as large as the length, in the direction of protrusion, of the absorbent, which enables the density distribution in the absorbent to be varied as desired.

In the method wherein the container is provided as described above, the portion of the absorbent, protruding from the edges of the pressing members, may be compressed by the pressing members in the second step.

The container made by the method as described above may be provided with a liquid outlet adjacent to a position in the container, where a relatively large volume of the absorbent protrusion from the edges of the pressing members used in the first step is received.

According to a still further aspect of the present invention, a method for inserting an absorbent to a container comprises: a first step of compressing the absorbent with a pair of pressing members opposed to each other, provided with diselectrifying means, a portion of the absorbent unevenly protruding from the pressing members: a second step of compressing the absorbent with another pair of pressing members opposed to each other, provided with diselectrifying means, in a direction crossing the direction of the compression in the first step; a step of inserting the absorbent to the container together with the pressing members maintaining the absorbent in a compressed state; and a step of removing the pressing members from the container while the absorbent is held in the container.

According to a yet further aspect of the present invention, a container receiving an absorbent is provided, made by a method which comprises: a first step of compressing the absorbent with a pair of pressing members opposed to each other, provided with diselectrifying means, a portion of the absorbent unevenly protruding from the pressing members; a second step of compressing the absorbent with another pair of pressing members opposed to each other, provided with diselectrifying means, in a direction crossing the direction of the compression in the first step; a step of inserting the absorbent to the container together with the pressing members maintaining the absorbent in a compressed state; and a step of removing the pressing members from the container while the absorbent is held in the container.

Further objects, features, and advantages of the present invention will become apparent from the following description of the preferred embodiments with reference to the attached drawings.

DESCRIPTION OF THE PREFERRED EMBODIMENT

Figure 1A:
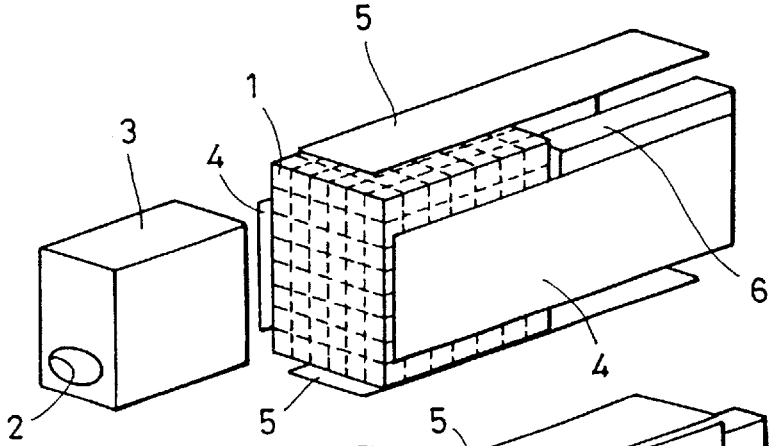
FIGS. 1A, 1B, 1C, and 1D are perspective views showing, in order, steps of inserting an absorbent to a container according to an embodiment of the present invention.

FIGS. 1A, 1B, 1C, and 1D show steps of inserting an absorbent to a container, according to an embodiment of the present invention.

A liquid container used for an ink container according to the embodiment includes an absorbent 1 impregnated with liquid ink and an ink container 3 having the absorbent 1 therein. The ink container 3 includes an ink outlet 2 for supplying the ink added to the absorbent 1 to an ink-jet printing head (not shown) for printing on a record medium (not shown).

The absorbent 1 formed in a rectangular shape is inserted to the ink container 31 compressed by pressing members 4, 5, and 6. As indicated in the drawings, both side surfaces of the absorbent 1 are pressed by a pair of first pressing members 4 and 4, the upper and the bottom surfaces of the absorbent 1 are pressed by a pair of second pressing members 5 and 5, and the rear side of the absorbent 1 is pressed by a third pressing member 6.

A process of inserting the absorbent 1 to the ink container 3 is described as follows.

In the first step as shown in FIG. 1A, the pressing members are disposed in such a manner as a pair of the first pressing members 4 and 4 opposed to each other, against both side surfaces of the absorbent 1, a pair of the second pressing members 5 and 5 opposed to each other, against the upper and the bottom surfaces of the absorbent 1, and the third pressing member 6 against the rear surface of the absorbent 1.

Figure 1B:
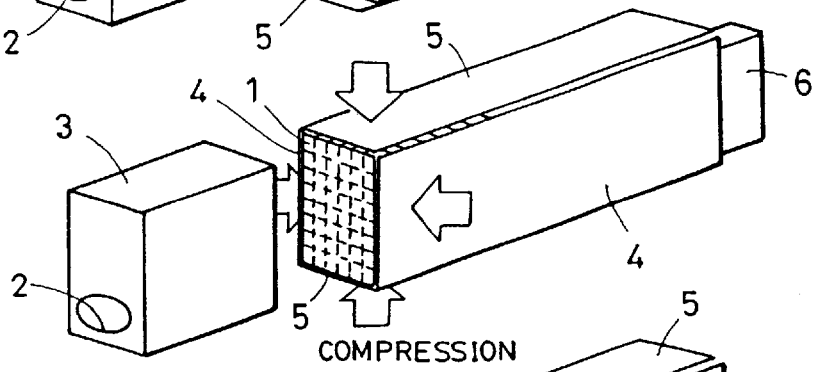

In the second step as shown in FIG. 1B, the absorbent 1 is compressed by a pair of the first pressing members 4 and 4, and a pair of the second pressing members 5 and 5, so that the horizontal length (the length between both side surfaces indicated in the drawing) and the vertical length (the length between the upper and the bottom surfaces indicated in the drawing) of the absorbent 1 are smaller than the inner horizontal length and the inner vertical length of the ink container 3 respectively.

Figure 1C:
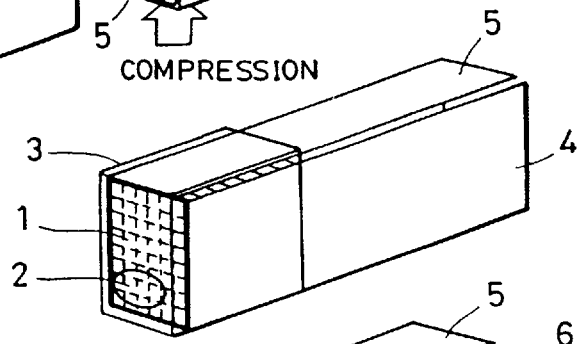

In the third step as shown in FIG. 1C, the absorbent 1 is inserted to the ink container 3, kept in a compressed state, together with the pressing members 4 and 5. The absorbent 1 is prevented from being wrinkled when inserted with the intervention of the pressing members 4 and 5 between the absorbent 1 and the inner walls of the ink container 3. Then, the absorbent 1 is pushed against the inner wall of the ink container 3 by the third pressing member 6 to be compressed so that the depth (the length between the front and the rear surfaces indicated in the drawing) is smaller than the inner depth of the ink container 3.

Figure 1D:
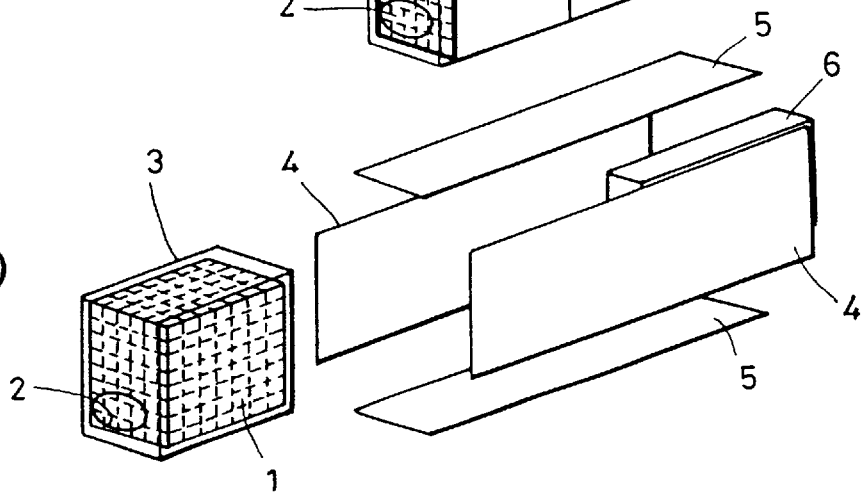

In the forth step, the pressing members 4 and 4 and the pressing members 5 and 5 are removed from the ink container 3, while the absorbent 1 stays in the ink container 3, being kept pressed by the third pressing member 6. Then, the third pressing member 6 is moved apart from the absorbent 1. Thus, the process of insertion of the absorbent 1 to the ink container 3 is completed, as shown in FIG. 1D.

The above-described insertion process reduces the danger of producing wrinkles on the absorbent 1 and/or gaps caused by improper contact of the absorbent 1 with the inner walls of the ink container 3.

Figure 2:
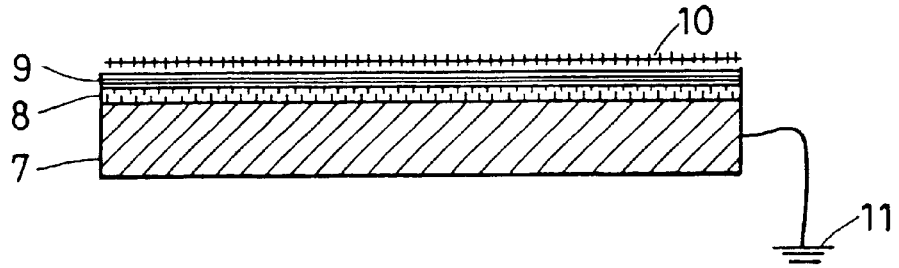
FIG. 2 is a sectional view of a pressing member, the surface thereof being electrically charged.
Figure 3:
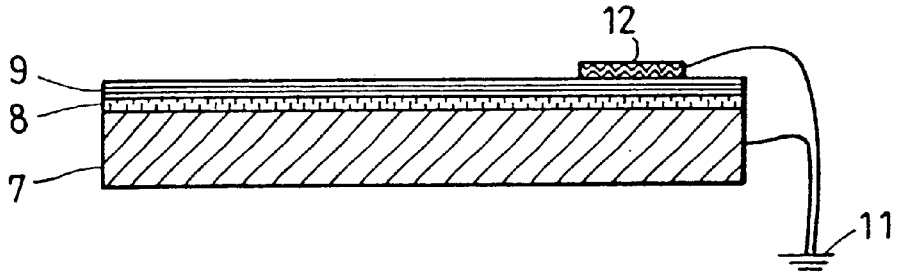
FIG. 3 is a sectional view of the pressing member, the surface thereof connected to ground through a conductive sheet for diselectrifying.
Figure 4:
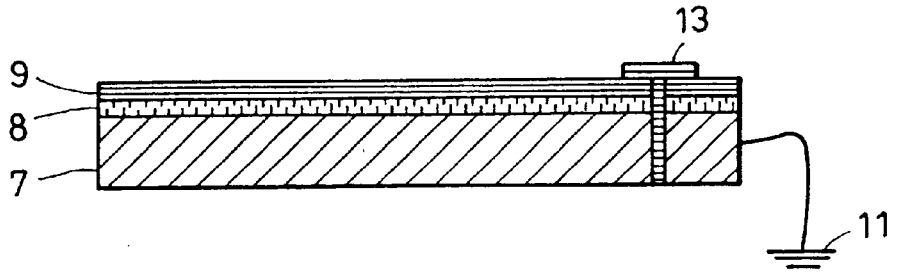
FIG. 4 is a sectional view of the pressing member, the surface thereof connected to ground through a screw for diselectrifying.
Figure 5:
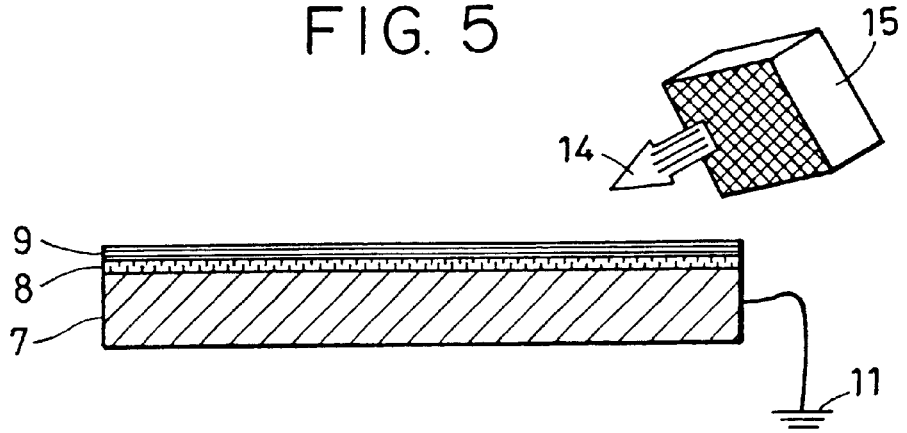
FIG. 5 is a sectional view of the pressing member, the surface thereof being diselectrified by a discharging blower.

In this case, when the first pressing members 4 and 4 and the second pressing members 5 and 5 are removed from the ink container 3 made, for example, of polypropylene, while the third pressing member 6 is pushing the absorbent 1 made, for example, of polyurethane, electric charge is applied, as shown in FIG. 2, by the friction between the absorbent 1 and the pressing members 4 and 5, and by the friction between the ink container 3 and the pressing members 4 and 5.

The electric charge is applied, as described above, on the absorbent 1, the ink container 3, the first pressing members 4 and 4, and the second pressing members 5 and 5. The electric charge applied on the absorbent 1 and the ink container 3 requires no consideration, because the insertion process concerning these units is performed only once, therefore, the effect of the charge thereon is negligible.

On the other hand, the electric charge applied and stored on the first pressing members 4 and 4 and the second pressing members 5 and 5, as shown by symbol + indicated by numeral 10 in FIG. 2, affects the following processes of inserting the absorbent 1. wherein the friction coefficient between the absorbent 1 and a pressing member 7 (the first, the second, and the third pressing members being generally represented by numeral 7) is different from when electric charge is not stored.

Further, the friction coefficient between the absorbent 1 and the pressing member 7 goes varying as the value of the electric charge on the pressing member 7 varies through the repeated insertion processes of the absorbent 1.

In order to stabilize the received state of the absorbent 1 in the container, the friction coefficient must be maintained constant through insertion processes, because the received state of the absorbent 1 is found to vary as the friction coefficient between the absorbent 1 and the pressing member 7 fluctuates. In short, the electric charge on the first pressing members 4 and 4 and the second pressing members 5 and 5 must be removed.

The ink container 3 is provided with an ink outlet 2. An adhesive layer 8 is disposed on the pressing member 7, and PTFE sheet 9 is disposed on the adhesive layer 8. A discharging blower 15 applies air ion 14.

Following is a description of a method, according to the embodiment, for diselectrifying the pressing member 7, in which the pressing member 7 is conductive and grounded as indicated by numeral 11.

The PTFE sheet 9 was diselectrified by grounding 11 through a conductive sheet 12 installed on the PTFE sheet 9 disposed on the pressing member 7, whereby the fluctuation of the received state of the absorbent 1 in the container, caused by the repeated insertion processes, could be reduced.

The PTFE sheet 9 was diselectrified by grounding 11 the PTFE sheet 9 through a screw 13 installed passing through the pressing member 7 and the PTFE sheet 9 disposed thereon, whereby the fluctuation of the received state of the absorbent 1 in the container, caused by the repeated insertion processes, could be reduced. The screw 13 installed passing through the pressing member 7 and the PTFE sheet 9 may prevent the pressing member 7 and the PTFE sheet 9 from being separated from each other.

The PTFE sheet 9 was diselectrified by applying the discharging blower 15 to the surface of the PTFE sheet 9 disposed on the pressing member 7, whereby the fluctuation of the received state of the absorbent 1 in the container, caused by the repeated insertion processes, could be reduced.

According to the present invention, as described above, the fluctuation of the friction coefficient can be reduced by diselectrifying the pressing members, thereby stabilizing the received state of the absorbent in the container. By removing the electric charge, moreover, the dust to be adsorbed on the surface of the pressing members can be reduced, which may lower the risk of receiving dust in the ink container during the insertion processes of the absorbent.

Following is the description of the compressing process of the absorbent 1 before the insertion to the container, in the method of inserting the absorbent to the liquid container, as indicated in FIGS. 1A, 1B, 1C, and 1D. The description is given in conjunction with FIGS. 6A, 6B, 6C, 6D, 7A, 7B, 7C, and 7D, which are sectional views showing compressing processes in the process of inserting the absorbent to the liquid container shown in FIGS. 1A, 1B, 1C, and 1D. FIGS. 6A to 6D indicate the process in which the compressive force of the pressing members applied to the absorbent is relatively large, and FIGS. 7A to 7D indicate the process in which the compressive force of the pressing members applied to the absorbent is relatively small. The density distribution in the absorbent compressed by the second pressing members varies according to the compressive force given by the first pressing members.

In the first step of the compressing process of the absorbent, according to the present embodiment, a pair of the first pressing members 4 and 4 hold the absorbent 1 at both side surfaces, and a pair of the second pressing members 5 and 5 hold the absorbent 1 at the upper and the bottom surfaces. The absorbent 1 is disposed so that its lower portion where the highest density is to be produced protrudes out of the lower edges of the first pressing members 4 and 4. The protrusion is preferably 0.01 to 0.5 times as long as the vertical length of the absorbent 1. Although the upper surface of the absorbent 1, according to the embodiment, is placed at the same level as the upper edges of the pressing members 4 and 4, the upper portion of the absorbent 1 may be protruded out of the upper edges of the pressing members 4 and 4. However, the portion of the absorbent 1 in which a desired density is to be produced is preferably placed lower than the upper edges of the pressing members 4 and 4.

Figure 6D:
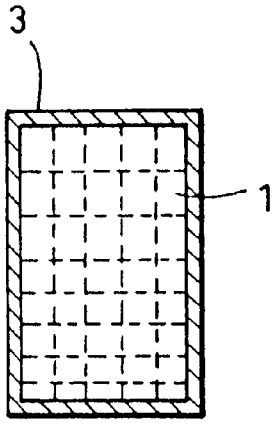
FIGS. 6A, 6B, 6C, and 6D are sectional views showing steps of compressing the absorbent, in the process of inserting the absorbent to the container, indicated in FIGS. 1A, 1B, 1C, and 1D.
Figure 6C:
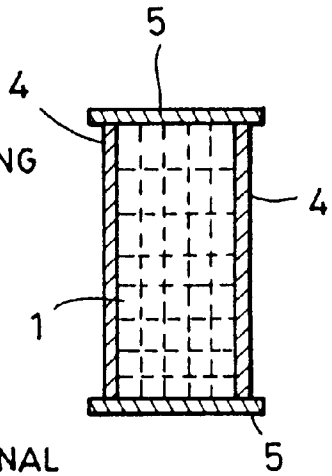
Figure 6B:
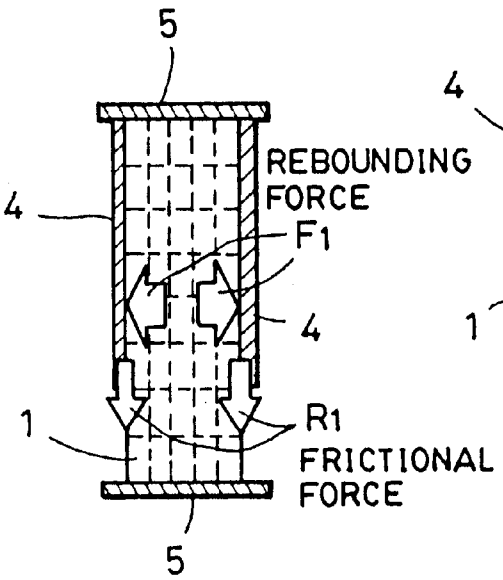
Figure 6A:
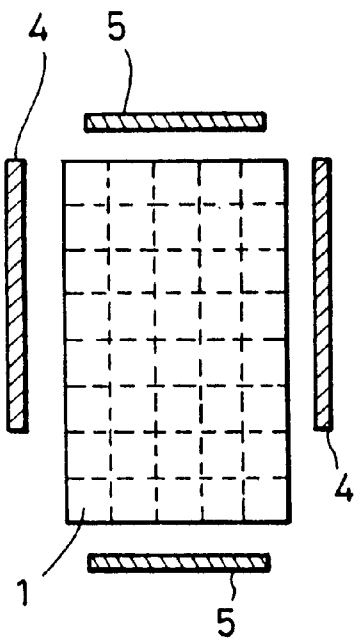
Figure 7A:
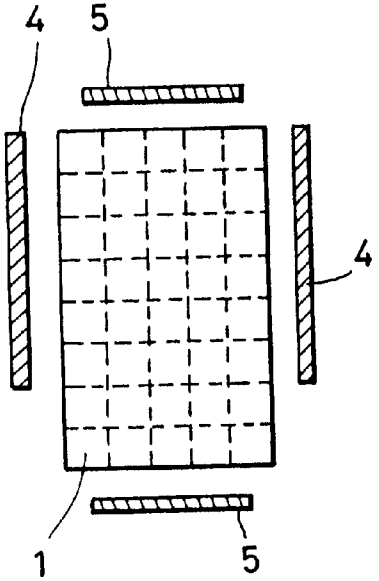
FIGS. 7A, 7B, 7C, and 7D are sectional views showing steps of compressing the absorbent, in the process of inserting the absorbent to the container, indicated in FIGS. 1A, 1B, 1C, and 1D.
Figure 7B:
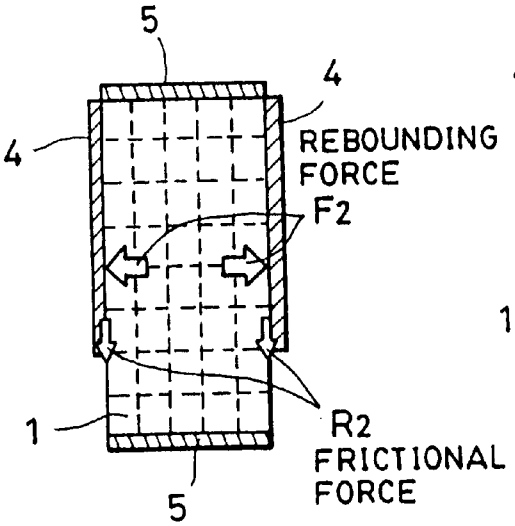

The following step is shown in FIGS. 6B and 7B, where the absorbent 1 is horizontally compressed by the first pressing members 4 and 4, thereby rebounding force $F_1$ (shown in FIG. 6B) or rebounding force $F_2$ (shown in FIG. 7B) of the absorbent 1 pushing back the pressing members 4 and 4 being generated. Frictional force $R_1$ (shown in FIG. 6B) and frictional force $R_2$ (shown in FIG. 7B) generated, when the second pressing members 5 and 5 vertically compress the absorbent 1, between the side surfaces of the absorbent 1 and the pressing members 4 and 4, are expressed by following expression in which the friction coefficient between the first pressing members 4 and 4 and the absorbent 1 is denoted by $\mu$.

$$R_1=\mu F_1,\ R_2=\mu F_2 \tag{1}$$

When the compressive force given to the absorbent 1 by the first pressing members 4 and 4 is relatively large, as indicated in FIG. 6B, the compressed amount of the absorbent 1 produced by the first pressing members 4 and 4 becomes larger than when the compressive force is relatively small, as indicated in FIG. 7B. In this case, the relation between rebounding forces $F_1$ (in FIG. 6B) and $F_2$ (in FIG. 7B) is expressed as follows.

$$F_1>F_2 \tag{2}$$

The relation between frictional forces $R_1$ (in FIG. 6B) and $R_2$ (in FIG. 7B) generated between the first pressing members 4 and 4 and the absorbent 1 is expressed by following expression reduced from expressions (1) and (2).

$$R_1>R_2 \tag{3}$$

As the frictional force generated between the first pressing members 4 and 4 and the absorbent 1 becomes larger, the compressive force given to the bottom surface of the absorbent 1 by the second pressing members 5 and 5 is less transmitted to the upper part of the absorbent 1, thus, the lower portion of the absorbent 1 is partially compressed (shown in FIG. 6C). As the frictional force generated between the first pressing members 4 and 4 and the absorbent 1 becomes smaller, the compressive force given to the bottom surface of the absorbent 1 by the second pressing members 5 and 5 is more likely to be transmitted to the upper portion of the absorbent 1, thus, the density of the absorbent is more evenly distributed (shown in FIG. 7C) than in the case shown in FIG. 6C.

The density distribution can be controlled not only by adjusting the compressive force of the fist pressing members 4 and 4, but also by adjusting the protruding amount (length) of the absorbent 1 out of the lower edges of the first pressing members 4 and 4. Namely, larger protruding amount makes larger difference in density according to the portion of the absorbent 1, and smaller protruding amount makes more evenly distributed density.

A desired density distribution can be obtained in the compression process of the absorbent, along the vertical direction in the absorbent 1, by controlling the compressive force horizontally given to the absorbent 1 by the first pressing members 4 an 4, and by controlling the protruding amount of the absorbent 1, to be vertically compressed by the second pressing members 5 and 5. An ink container for efficiently utilizing the ink added to the absorbent 1 can be provided by disposing the ink outlet 2 adjacent to the position in the ink container, where the highest density portion of the absorbent 1 is received, as indicated in FIG. 1D.

Figure 7C:
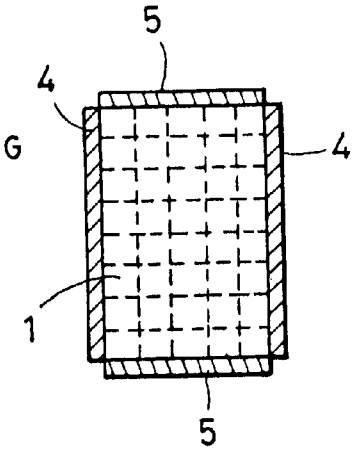
Figure 7D:
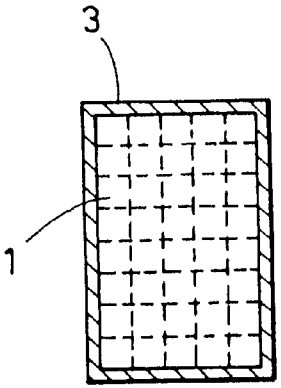

The absorbent 1 is compressed by the first pressing members 4 and 4 and the second pressing members 5 and 5, as shown in FIGS. 6C and 7C, to be smaller than the inner dimension of the ink container 3 for receiving the absorbent 1, which is restored by rebounding force thereof to hermetically contact to the inner walls of the ink container 3, as indicated in FIGS. 6D and 7D, after the pressing members 4 and 4 and the pressing members 5 and 5 are removed from the ink container 3. The density distribution in the absorbent 1 is maintained, after restoring, as it is produced when inserted.

The absorbent 1 may be made of one of polypropylene, polyethylene, and the combination of polypropylene and polyethylene, instead of polyurethane as described in the present embodiment. The material for manufacturing the container may be selected from either a polystyrene resin or polyethylene terephthalate, in place of polypropylene used in the embodiment. The pressing members may be directly coated with PTFE or a fluorocarbon resin, instead of PTFE sheet disposed thereon, according to the embodiment, with the intervention of an adhesive layer. Polyethylene film may be disposed on the pressing members. Also, the pressing members may be made of a PTFE resin, subject to strength being assured.

A liquid container receiving an absorbent therein can be provided, according to the present invention, having varied density depending on the portion of the absorbent, by compressing the absorbent with a pair of first pressing members at two surfaces opposed to each other, then, compressing the absorbent with a pair of second pressing members at other two surfaces opposed to each other, in a direction crossing the compression direction of the first pressing members, whereby the liquid container can efficiently utilize the liquid added to the absorbent.

Electric charge is stored on the pressing members, as described above, caused during repeated operation by the friction between the absorbent and the pressing members, which may be removed by application of diselectrifying means, as proposed in the embodiment, thereby stabilizing the received state of the absorbent in the container.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A manufacturing apparatus for manufacturing a liquid container having a main body with an air path opening and a supply opening, said main body for holding an absorbent therein, said apparatus comprising:

a pair of first pressing members for pressing said absorbent; and a pair of second pressing members for pressing said absorbent in a direction crossing the direction in which said first pressing members press the absorbent, wherein said first pressing members and said second pressing members are grounded.

2. A manufacturing apparatus according to claim 1, wherein surfaces contacted with said absorbent of said first and second pressing members are processed with one of polytetrafluoroethylene (PTFE) and a fluorocarbon resin.

3. A manufacturing apparatus according to claim 2, wherein the processed surfaces are connected to a conductive material.

4. A manufacturing apparatus according to claim 3, wherein said conductive material is grounded.

5. A manufacturing apparatus according to claim 3, wherein said conductive material is a conductive sheet and a conductive feedthrough member.

6. A manufacturing apparatus according to claim 2, wherein said fluorine process attaches a sheet to the pressing members or coats the pressing members directly with one of polytetrafluoroethylene (PTFE) and a fluorocarbon resin.

7. A manufacturing apparatus according to claim 2, further comprising a diselectrifying blower for removing electric charge from said processed surfaces.

8. A manufacturing apparatus according to claim 1, wherein said absorbent is made of polyurethane, polyethylene or a combination thereof.

* * * * *

UNITED STATES PATENT AND TRADEMARK OFFICE

CERTIFICATE OF CORRECTION

PATENT NO. : 6,505,925 B2
DATED : January 14, 2003
INVENTOR(S) : Kitabatake et al.

It is certified that error appears in the above-identified patent and that said Letters Patent is hereby corrected as shown below:

Title page,
Item [56], References Cited, FOREIGN PATENT DOCUMENTS,
"9-131877" should read -- 9-131887 --; and Item [57], ABSTRACT,
Line 2, "then" should read -- than --.

Column 5,
Line 21, "31" should read -- 3, --.

Signed and Sealed this

Ninth Day of December, 2003

JAMES E. ROGAN
*Director of the United States Patent and Trademark Office*